United States Patent [19]

Wilensky et al.

[11] Patent Number: 4,472,707

[45] Date of Patent: Sep. 18, 1984

[54] DISPLAY PROCESSOR DIGITAL AUTOMATIC GAIN CONTROL PROVIDING ENHANCED RESOLUTION AND ACCURACY

[75] Inventors: Barry F. Wilensky; Joseph A. Maggi, both of Brooklyn, N.Y.

[73] Assignee: Allied Corporation, Morris Township, Morris County, N.J.

[21] Appl. No.: 389,641

[22] Filed: Jun. 18, 1982

[51] Int. Cl.[3] ..... G09G 1/10

[52] U.S. Cl. ..... 340/736; 340/739; 340/741; 358/174; 315/367; 315/370

[58] Field of Search ..... 340/736, 739, 741, 742, 340/980; 358/174, 179; 315/370, 371, 387, 367, 8; 364/521

[56] References Cited

U.S. PATENT DOCUMENTS

| | | | |
|---|---|---|---|
| 3,510,865 | 5/1970 | Callahan et al. | 340/741 |
| 3,665,410 | 5/1972 | Holland . | |
| 3,781,848 | 12/1973 | Rosenthal | 340/736 |
| 3,821,727 | 6/1974 | Erickson et al. | 340/741 |
| 3,872,348 | 6/1973 | Astley | 315/10 |
| 4,053,946 | 10/1977 | Opittek et al. | 364/900 |
| 4,099,092 | 7/1978 | Bristow | 315/370 |
| 4,240,073 | 12/1980 | Seats et al. | 340/736 |
| 4,287,506 | 9/1981 | Richards | 315/370 |
| 4,301,393 | 11/1981 | Shoji et al. | 315/367 |
| 4,346,333 | 8/1982 | Dagostino | 315/367 |
| 4,434,439 | 2/1984 | Steckler et al. | 358/174 |
| 4,441,057 | 4/1984 | Wrona | 315/367 |

OTHER PUBLICATIONS

Journal of Physics Scientific-Instruments, vol. 3, No. 8, Aug. 1970, Hankins and Roberts.

*Primary Examiner*—Gerald L. Brigance

*Attorney, Agent, or Firm*—Joseph E. Funk; Anthony F. Cuoco

[57] ABSTRACT

A Digital Automatic Gain Control for a display system having a video display driven by a remote display generator including a display processor which generates binary words that are converted by multiplying digital-to-analog converters to analog deflection voltages that are applied to the video display. The deflection voltages applied to the display are sensed and a digital feedback signal is derived therefrom that is returned to the display generator. The digital feedback signal has a word size larger than the word size of the binary words generated by the display processor. The feedback signal is processed and applied to multiplying digital-to-analog converters and output amplifiers to modify the conversion from binary words to analog deflection voltages to thereby accomplish higher display resolution and accuracy than can be achieved by the display processor alone due to limited binary word size. Higher resolution is achieved because the operation of the converters and amplifiers permits more than one analog output voltage level to be provided for each binary number input to the converters from the display processor.

8 Claims, 4 Drawing Figures

DISPLAY PROCESSOR DIGITAL AUTOMATIC GAIN CONTROL PROVIDING ENHANCED RESOLUTION AND ACCURACY

BACKGROUND OF THE INVENTION

Automatic gain control circuits utilizing digital feedback are known in the prior art. In particular, such automatic gain control circuits utilizing digital feedback are advantageously used to replace various analog feedback control techniques that have previously been used with random stroke deflection signal generation in video displays to correct for system transmission losses between a display signal generator and a remote video display. With these prior art analog feedback techniques the feedback signal itself is subject to transmission losses that limit the effectiveness of such analog techniques and has led to the use of automatic gain control circuits with digital feedback in the remote display applications to increase the display resolution and accuracy. The number of discrete control levels available to a digital display generator is primarily limited to the binary bit size of the binary words that can be generated thereby. For example, a digital display generator using a processor utilizing an eight bit binary word can only identify two hundred fifty-six different discrete control levels as is known by those skilled in the art.

Very often it is desired to specify more discrete control levels than can normally be addressed by a given word bit size, and in particular in the use of a display generator or processor for testing of video display systems. In the test mode it may be desirable to make differential or relative type measurements thereby requiring resolution capabilities greater than would normally be needed for that display processor. A prior art solution to this problem is for a display processor to make an address up of two binary words sequentially generated. However, this approach introduces much complexity into the equipment and computer programs and slows the microprocessor down since it must spend more time generating, transmitting and receiving two part addresses and to control other equipment to do so. This is totally unacceptable in a display processor application where signal generation must be accomplished in real time.

Thus, there is a need in the art for a method and equipment for providing an automatic gain control circuit using digital feedback that can increase display resolution and accuracy beyond that normally obtainable with a display processor having a given bit word size without using multiple-part addressing.

SUMMARY OF THE INVENTION

The above need in the prior art is satisfied by our invention. In the embodiment of our invention disclosed herein a display generator, including a microprocessor being used as a random stroke display processor, responds to signals indicating a given character to be displayed to generate binary words which are converted to analog voltages by digital-to-analog converters and then forwarded to a video display where the analog voltages are applied to the X and Y deflection channels of a cathode ray tube (CRT) to display the character thereon. The display processor in the display generator is a special purpose processor generating only twelve bit binary words which, when converted to analog voltages, provide 4,096 discrete voltage levels to each of the X and Y deflection channels. This defines the resolution or the number of points on the face of the CRT to which its electron beam may be deflected.

In some display applications, such as in an aircraft cockpit where space is at a premium the display generator must be located remote from the video display and to further conserve space even the digital-to-analog converters that produce the analog X and Y deflection voltages must be located remote from the CRT. Furthermore, in test applications the signal generator is remotely located from the Display Unit to be tested since the Display Unit is usually located on an optical test bench and the signal generator is generally located in a test station complex. This situation introduces an unavoidable problem. Due to long cable losses, stray capacitance, drift and gain variation of amplifiers with time and temperature, and other factors making up overall system losses, the electron beam of the CRT usually will not be deflected to the desired point on its face. Although there is twelve bit resolution available, the accuracy may be much less than one least significant bit. An arrangement is needed to provide an accurate feedback signal indicating the actual position or the best indication of position that the electron beam is striking on the face of the CRT and the display generator is responsive to the feedback signals to compensate for the effect of the losses on the deflection signals and the feedback signals. To prevent these same losses from affecting the feedback signal it is converted to a binary digital signal which is returned to the display generator. In addition controlled known reference voltages are provided at or near the video display remote from the display generator to provide automatic calibration of the feedback path. The reference voltages are continuously available for software algorithm correction of the feedback path variations. Furthermore, when testing Display Units there are two basic test requirements, namely to first position the electron beam to a known accurate location as described above and second to be able to incrementally adjust the position of the electron beam. The resolution of this incremental adjustment must be greater than the initial required resolution or accuracy that can be provided by the twelve bit display processor. In accordance with the teaching of our invention we provide two types of feedback correction signals. These correction signals are (1) the binary signals fed back to the display generator can be twelve bits or more to meet or exceed the initial accuracy and, (2) an error correcting signal that provides effectively greater resolution than the display generator resolution. Accordingly, since the display processor is a special purpose twelve bit microprocessor with capabilities limited to the generation of display commands, the feedback signals are not routed to the display microprocessor, but are input to either a simple general purpose feedback microprocessor or to special purpose error correcting hardware. This feedback processor must have an equivalent resolution of greater than twelve bits. This resolution can be achieved in single or multiple processing steps since the beam correction can occur over one or more display refresh cycles, depending on the closed loop performance requirements. The first correction signals are coverted to discrete analog voltages which are applied to the same digital-to-analog converters to which the display processor originally applied the twelve bit binary words to be converted to the analog x and Y deflection voltages. More particularly, these last mentioned digital-to-analog converters are multiplying digital-to-analog converters and the discrete level analog correction signals applied thereto causes the slope of the transfer characteristic curve of the multiplying digital-to-analog converters to change. The second correction signals are derived from the accurate reference voltages at or near the remote video display. The feedback processor responds to these voltages to change the offset voltage of analog differential amplifiers connected to the output of the multiplying digital-to-analog converters to thereby provide a scaling factor to the analog deflection voltages output from the converters. By using these two types of correction signals the analog voltage output from the multiplying digital-to-analog converters may be varied to achieve desired resolution and accuracy of the display on the CRT. The result is not only that a feedback mechanism has been provided between the display generator and remote display, but also that greater display resolution and accuracy has been achieved than previously possible in the art.

DESCRIPTION OF THE DRAWING

Our invention will be better understood upon reading the following detailed description in conjunction with the drawing in which.

DETAILED DESCRIPTION OF THE INVENTION

Figure 1:
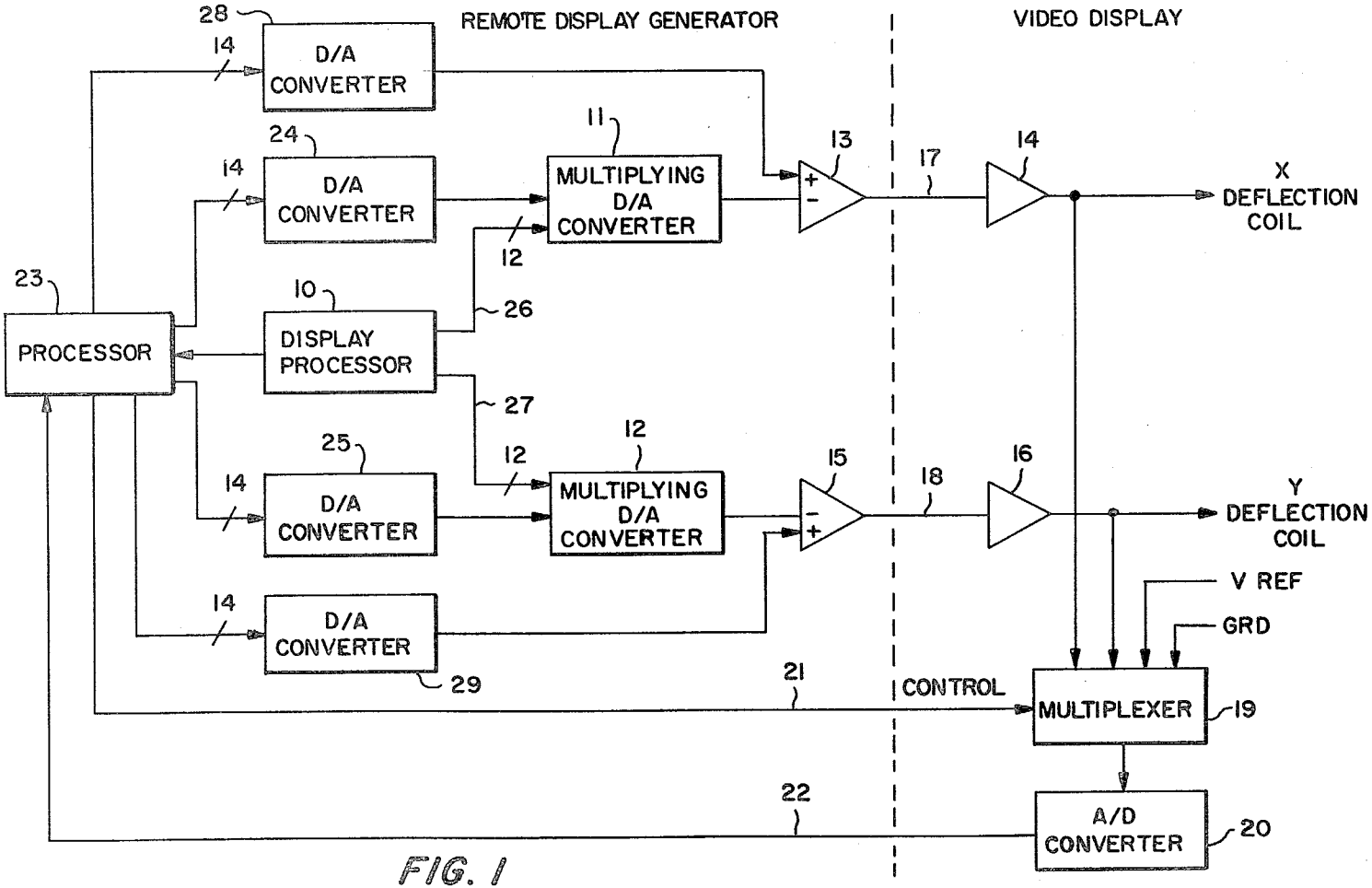
FIG. 1 is a schematic block diagram of a display system in which our novel digital automatic gain control is used.

In FIG. 1 is shown a schematic block diagram of our invention utilized with a display system providing a video display in an aircraft cockpit where space is at a minimum or in a test system where the video display is remotely located from the test display generator. The display system actually consists of two parts. The first part is the video display which is located in the aircraft cockpit and has a minimal amount of electronics located therewith due to space constraints. The second part of the display system is a display generator which is located remote from the video display and analog video signals are forwarded over some distance from the remote display generator to the video display.

A special purpose display processor 10 responds to a source of display information (not shown) to generate binary signals which ultimately cause the display of the information at the remote video display. This information may be a radar display, a map display, an aircraft instrumentation display, or a test pattern. Whatever the information to be displayed display processor 10 generates binary numbers on its output leads 26 and 27 which respectively cause the generation of X and Y analog deflection signals which are forwarded to the video display in the cockpit to an optical test bench where the signals are applied to the X and Y deflection channels of a CRT (not shown) of the video display to control the deflection of the CRT electron beam. Display processor 10 is a special purpose twelve bit word processor and, accordingly, the binary words output on leads 26 and 27 are also each twelve bit words output in bit parallel format to each of multiplying digital-to-analog converters 11 and 12. Converters 11 and 12 are manufactured by Analog Devices and are designated as their Model 566 Multiplying Digital-To-Analog Converter. The output from each of converters 11 and 12 are analog voltages which are respectively input to differential amplifiers 13 and 15 to be amplified before being transmitted over lengths of cable 17 and 18 to the display. The X and Y analog deflection voltages on cables 17 and 18 are again amplified by amplifiers 14 and 16 respectively before being applied to the X deflection coil and the Y deflection coil (both not shown) on the neck of the CRT (not shown) of the video display located in the aircraft cockpit remote from the display generator. Due to losses of one type or another, such as in cables 17 and 18 which may be long, amplifier drift and other system losses the analog deflection signals applied to the X deflection coil and Y deflection coil may deflect the electron beam of the CRT to a spot on the face thereof that is different from the spot to which the beam is desired to be deflected. To overcome this problem our novel feedback arrangement is provided which receives feedback signals and modifies the analog voltages output from multiplying digital-to-analog converters 11 and 12 and also modifies the offset voltages of buffer amplifiers 13 and 15 so that the electron beam of the CRT of the video display is deflected to the proper point. In this embodiment, to accomplish this feedback the analog voltages at the outputs of amplifiers 14 and 16 at the video display are input to a conventional multiplexer 19 as well as being applied to the deflection coils. Multiplexer 19 is under control of a feedback processor 23 in the remote display generator via control leads 21 to sequentially, synchronously and individually connect the outputs of amplifiers 14 and 16 through to conventional analog-to-digital converter 20. The sample points in time made using multiplexer 19 may be programmably selected anywhere in the refresh cycle. Two reference voltages $V_{ref}$, one being zero volts, are also applied to inputs of multiplexer 19. Converter 20 causes the analog voltages output from amplifiers 14 and 16 or the reference voltages $V_{ref}$ to be converted to at least a twelve bit binary number which is returned over cable 22 to processor 23. The feedback signals are converted to binary number form to eliminate the affect of system losses in the feedback path 22. The feedback signals provide display resolution and accuracy that is required but which cannot be achieved by the open loop forward transfer function. Feedback processor 23 responds to the binary feedback signal from the display on feedback leads 22 to determine if the points on the CRT face that the electron beam is striking are those specified by display processor 10 and generates an equivalent fourteen bit binary word for modifying the offset using differential amplifiers 13 and 15 and the transfer characteristic of converters 11 and 12 to change the X and Y deflection signals. These fourteen bit binary correction words are respectively input to conventional digital-to-analog converters 24, 25, 28 and 29. The output from each of digital-to-analog converters 24 and 25 is a reference analog voltage which is respectively input to multiplying digital-to-analog converters 11 and 12 to set the slope of the transfer characteristic curve of these converters. The output from each of digital-to-analog converters 28 and 29 is an analog voltage which is shown input to differential amplifiers 13 and 15 but which may alternatively be input to converters 11 and 12. The output voltages from converters 28 and 29 can be scaled down such that less than a twelve bit input to these converters can still provide an equivalent of fourteen bit resolution at the output of amplifiers 13 and 15. The purpose is to achieve greater resolution and accuracy and is discussed in more detail hereinafter with reference to FIGS. 2, 3 and 4.

To calibrate the feedback system of our invention there is a third and a fourth calibration voltage input to multiplexer 19 from a reference voltage $V_{ref}$ and signal ground. At an appropriate time processor 23 applies a signal via control cable 21 to multiplexer 19 to connect either this reference voltage or signal ground to analog-to-digital converter 20 which converts same to a binary number which is returned over leads 22 to processor 23. Processor 23 utilizes these binary numbers, which it knows are generated in response to the fixed calibration reference voltages, to determine the scale factor of the feedback transfer function. This scale factor is used to correlate the deflection voltages applied to the X and Y deflection channels. Thereafter, as binary number feedback signals are received over cable 22 indicating the analog voltage levels output from amplifiers 14 and 16, processor 23 knows what the analog voltages output from amplifiers 14 and 16 are and, when comparing them to the voltages it knows they should be, is able to generate appropriate binary words to converters 24, 25, 28 and 29 to change the slope of the transfer characteristic of converters 11 and 12 and to change the transfer characteristic of differential amplifiers 13 and 15 to accomplish appropriate correction of the analog deflection signals output from amplifiers 14 and 16.

Figure 2:
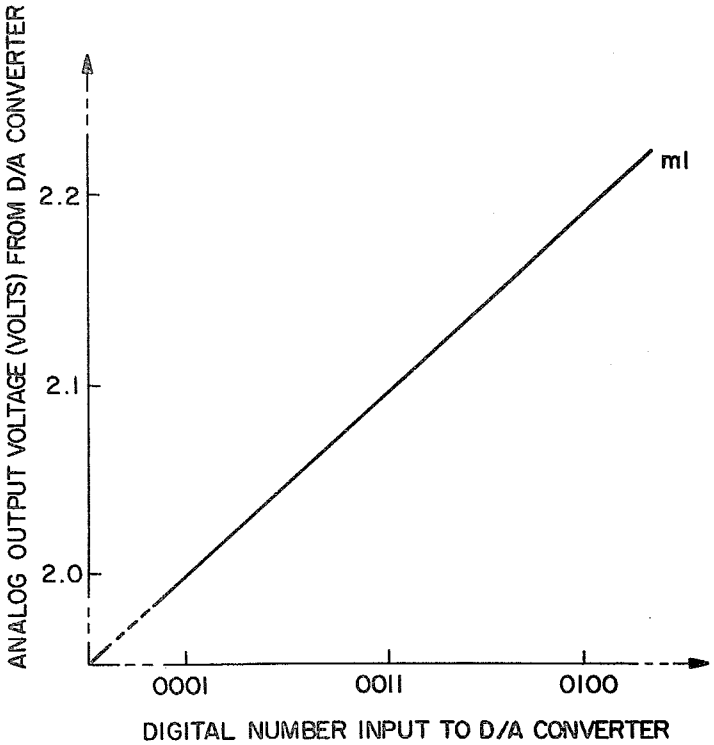
FIG. 2 shows the characteristic curve of an exemplary digital-to-analog converter correlating the analog voltage output from the converter with the binary numbers input thereto.

In FIG. 2 is shown the slope of the transfer characteristic of an exemplary digital-to-analog or analog-to-digital converter. The numbers used along the X and Y axis of this graph in FIG. 2 are for discussion purposes only and are not meant to reflect that these values are typical for analog-to-digital or digital-to-analog converters. They are only used to give an understanding of how these converters generally work. For example, in the case of a digital-to-analog converter, if the digital-to-analog converter has a four bit word input and the binary number applied thereto at a particular moment in time is the binary number 0001 output from this converter is 2.0 volts. This is derived by drawing a line vertically from the binary number 0001 to its intersection with the straight line curve having the slope ml and then drawing a horizontal line from this intersection point to the intersection with the Y axis which, in this case, is the 2.0 volts. Similarly, if the binary number input to the four bit input of this exemplary digital-to-analog converter is 0100, utilizing the technique just described we find that the output from the digital-to-analog converter is 2.2 volts. In this operation each binary number applied to the input of such a digital-to-analog converter can only result in one analog voltage being output from the converter. Using the converse of the technique described immediately hereinabove to reflect the operation of an analog-to-digital converter, we start on the vertical axis with an analog voltage such as 2.1. We go horizontally from the value 2.1 volts to the straight line curve having the slope ml and from the intersection with this curve we go vertically down to the horizontal axis to find the binary number 0011 which would be the four bit binary number output from this exemplary analog-to-digital converter.

Figure 3:
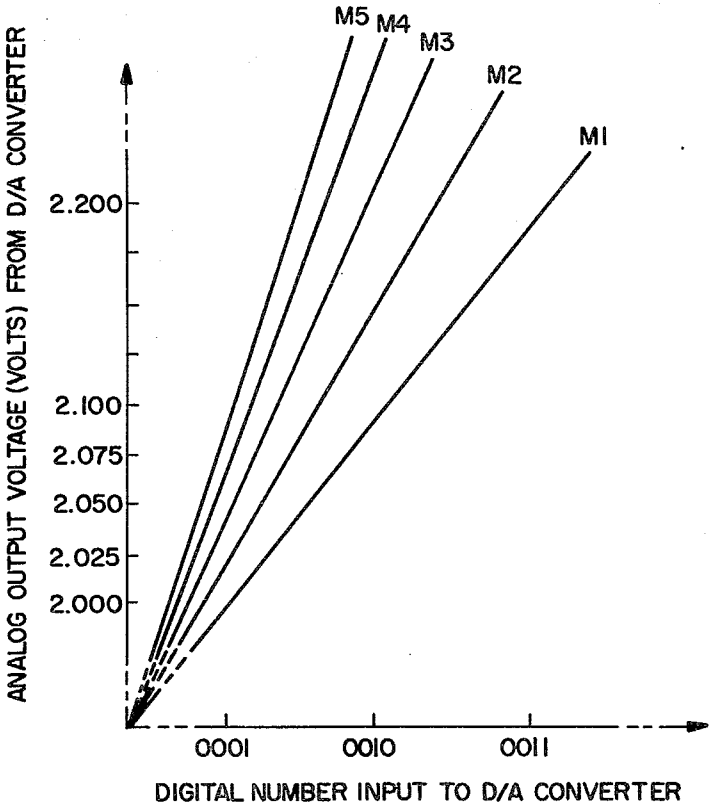
FIG. 3 shows the characteristic curves of an exemplary multiplying digital-to-analog converter correlating a plurality of analog voltages output therefrom for each binary number input thereto.

In FIG. 3 are shown straight line transfer characteristic curves for a multiplying digital-to-analog converter. Again, the numbers along the vertical and horizontal axis of this graph are only exemplary and not meant to accurately reflect the voltages or binary numbers typically input or output from a multiplying digital-to-analog converter. As previously mentioned in this specification multiplying digital-to-analog converters 11 and 12 each have an input to which an analog voltage is applied to set the slope of the straight line transfer characteristic curve of the converter. For instance, with a first undefined analog voltage applied to the last mentioned input of multiplying digital-to-analog converters 11 and 12, the slope of the transfer characteristic of these converters could be the straight line having the slope ml shown in FIG. 3. With this particular transfer characteristic, when the four bit binary word 0001 is applied to the digital input of the multiplying digital-to-analog converter the output voltage would be 2.000 volts. Similarly, if the four bit binary number input to the converter is 0011 the output would be 2.200 volts. However, if we change the analog voltage input to the multiplying digital-to-analog converter to change its transfer characteristic we can get characteristics having slopes such as m2, m3, m4 and m5. When the slope of the transfer characteristic curve is m2 and the binary number input to the converter is 0001 the output from the converter will be 2.025 volts. Similarly, when the slope of the transfer characteristic curve is m3, with the same binary input number 0001 the output voltage from the converter is 2.050 volts. When the transfer characteristic has a slope equal to m4 the input binary number 0001 will yield an output voltage of 2.075 volts. Again, when the transfer characteristic curve has a slope equal to m5 the same input binary number 0001 will yield an analog output voltage of 2.100 volts. Thus, it can be seen that with a single input binary number to such an exemplary multiplying digital-to-analog converter there can be many analog voltages output therefrom depending upon the analog control voltage also input to the converter. Multiplying digital-to-analog converters 11 and 12 in FIG. 1 have twelve bit binary number inputs which by themselves can only define 4,096 discrete voltage levels. This is not enough to provide the resolution and accuracy required in our display system. However, by using the feedback signals processed and converted to analog voltage levels via digital-to-analog converters 24 and 25 the slope of the characteristic curve of the multiplying digital-to-analog converters 11 and 12 may be changed as shown in FIG. 3 resulting in 16,384 discrete voltage output levels for each digital word input from converters 11 and 12.

Figure 4:
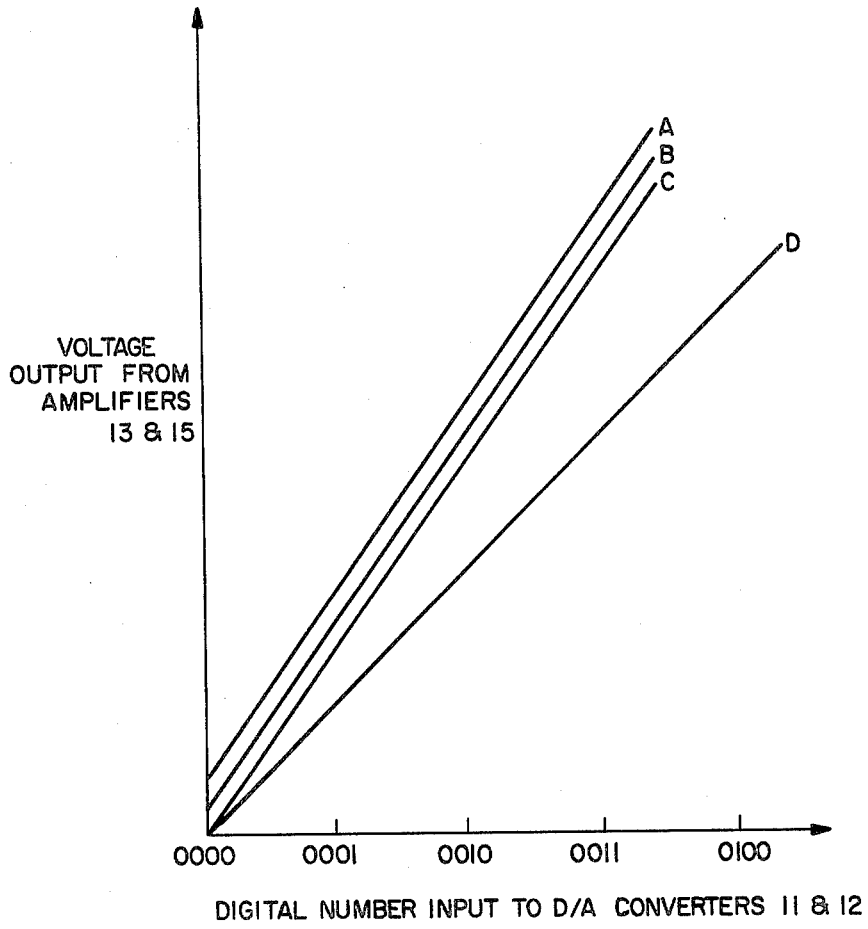
FIG. 4 shows characteristic curves for an exemplary multiplying digital-to-analog converter, which curves are translated by an offset voltage responsive to a correction signal.

In FIG. 4 is shown the transfer characteristic curves of the combination of multiplying digital-to-analog converters 11 and 12 and analog amplifiers 13 and 15. Curves A and B reveal transfer characteristics with non-zero offsets and incorrect slopes as compared to ideal curve D. By using the feedback signals processed and converted to analog voltage levels by converters 28 and 29, the offset voltage at the output of amplifiers 13 and 15 respectively may be changed to obtain the characteristic shown in curve C. The resolution of the offset voltage adjustment may be obtained by either of two approaches. The first is to utilize fourteen bit offset digital-to-analog converters 28 and 29 whose output is directly input to multiplying digital-to-analog converters 11 and 12. The second approach is to obtain the equivalent of fourteen bit resolutions by using an offset digital-to-analog converter of less than fourteen bits (typically eight bits) and then to scale the offset output voltages of converters 28 and 29. Although this method reduces the full scale offset voltage range as compared to the previously described method, however, for these applications, this reduction in range is totally acceptable since offset adjustment is typically not greater than 1% total range. It is this second approach that is shown in FIG. 4 and which is our preferred embodiment.

The above techniques depicted in FIGS. 3 and 4 are sufficient to provide the resolution and accuracy required by our display. Utilizing our invention the limitation in resolution and accuracy when using twelve bit display processor 10 is overcome. The beam of the electron tube may be deflected to as many points as would be defined in display processor 10 was a fourteen bit processor. In addition, a feedback function is accomplished to assure that, despite system losses and inaccuracies, the electron beam is deflected to strike a known specified point on the face on the cathode ray tube.

It would be obvious to those skilled in the art that other arrangements of our invention may be utilized. For example, the exact number of bits of the display processor of the feedback processor is not important. Rather than using a special purpose twelve bit display processor a conventional eight bit processor may be utilized for the display processor and the feedback processor may be a conventional processor with an equivalent word size of greater than the display processor word size, (either direct or multiplexed) and the same advantageous results may be achieved. The binary numbers returned as feedback from the display to the remote display generator may be applied to electronic circuitry having a fixed transfer function which work on the binary numbers fed back from the display to create new binary numbers which would be applied to digital-to-analog converters 24 and 25. Further, rather than using a general computer as feedback processor 23, a plurality of electronic parts may be combined to create a special purpose feedback processor which can only function for this purpose of receiving binary numbers as feedback from the display and processing them to create other binary numbers used to correct the display. In this manner the special purpose feedback processor could have any desired variable transfer function.

What we claim is:

1. A digital automatic gain control apparatus for controlling a video generator that provides display signals used to control the deflection of the electron beam of a cathode ray tube of a remote video display, the apparatus being used to compensate for system inaccuracies and enhancing resolution of the display generator, and wherein a first series of binary numbers supplied by the display generator are provided indicating the deflection of the electron beam to trace a display on the face of the cathode ray tube comprising:

means for converting said first series of binary numbers to analog signals which are forwarded to said cathode ray tube to deflect said electron beam to trace said display, means for sensing the analog signals actually applied to said cathode ray tube and generating a second series of binary numbers indicating the position of the electron beam at specified moments in time while tracing said display, and means for processing said second series of binary numbers to determine if said electron beam is properly positioned on the face of said cathode ray tube at said specified moments in time while in the process of tracing said display, said processing means providing correction signals for offset and gain control which are utilized by said converting means to modify the conversion of said first series of binary numbers to said analog signals so that said electron beam is properly positioned on the face of said cathode ray tube while in the process of tracing said display.

2. The apparatus in accordance with claim 1 wherein said first series of binary numbers comprises two series of binary numbers respectively indicating the X and Y deflection of the electron beam of said cathode ray tube to trace said display, wherein said converting means has a conversion characteristic relating a binary number input to an analog voltage output, and comprises two multiplying digital-to-analog converters the conversion characteristics of each of which are modified by the correction signals from said processing means to compensate for said system losses.

3. The apparatus in accordance with claim 2 further comprising two amplifiers, one amplifier associated with each of said converting means with an input of one of said amplifiers being connected to the output of one of said converting means to amplify said analog signals, said amplifiers having their gain modified responsive to said correction signals.

4. The apparatus in accordance with claim 3 wherein said correction signals comprise first correction signals applied to said multiplying digital-to-analog converters and second digital correction signals applied to said amplifiers, and wherein said converting means further comprises two conventional digital-to-analog converters for converting said second digital correction signals to analog signals which are applied respectively to each of said amplifiers to change the gain thereof.

5. The apparatus in accordance with claim 4 wherein said sensing means comprises:

an analog-to-digital converter for converting the X and Y deflection analog voltages actually applied to said cathode ray tube to said second series of binary numbers, and a multiplexer for alternately applying said X and Y deflection analog voltages to said analog-to-digital converter to be converted to said second series of binary numbers which are processed by said processing means to provide said correction signals to said two multiplying digital-to-analog converters and output amplifiers.

6. The apparatus in accordance with claim 5 further comprising a reference voltage source which is connected via said multiplexer to said analog-to-digital converter for conversion to a binary number utilized by said processing means to correlate said second series of binary numbers to actual values of said X and Y analog deflection voltages.

7. A method for providing automatic gain control to a video display generator that provides display signals used to control the deflection of the electron beam of a cathode ray tube of a remote video display to compensate for system losses and inaccuracies, and wherein said display generator provides a first series of binary numbers indicating the deflection of the electron beam to trace a display on the face of the cathode ray tube comprising the steps of:

converting said first series of binary numbers to X and Y analog deflection voltages which are forwarded to said catode ray tube to control the deflection of said cathode ray tube electron beam to trace said display;

sensing the analog voltages actually applied to said cathode ray tube to deflect said electron beam and providing a second series of binary numbers indicating the beam position at specified moments-in-time;

analyzing said second series of binary numbers to determine if said electron beam is properly positioned on the face of said cathode ray tube while in the process of tracing said display and providing correction signals, and modifying the conversion of said first series of binary numbers to said analog voltages responsive to said correction signals so that said electron beam is properly positioned on the face of said cathode ray tube while in the process of tracing said display.

8. The method in accordance with claim 7 wherein the step of sensing the analog voltages actually applied to said cathode ray tube comprises the steps of:

selecting alternately the X and Y analog deflection voltages applied to said cathode ray tube, and converting said alternately selected analog deflection voltages to said second series of binary numbers.

* * * * *